US010995958B2

(12) United States Patent
Shershnyov et al.

(10) Patent No.: US 10,995,958 B2
(45) Date of Patent: May 4, 2021

(54) PILOT FUEL INJECTOR, AND FUEL NOZZLE AND GAS TURBINE HAVING SAME

(71) Applicant: DOOSAN HEAVY INDUSTRIES & CONSTRUCTION CO., LTD., Changwon-si (KR)

(72) Inventors: Borys Shershnyov, Changwon-si (KR); Yunyoung Doh, Changwon-si (KR)

( * ) Notice: Subject to any disclaimer, the term of this patent is extended or adjusted under 35 U.S.C. 154(b) by 103 days.

(21) Appl. No.: 16/248,517

(22) Filed: Jan. 15, 2019

(65) Prior Publication Data

US 2019/0277502 A1 Sep. 12, 2019

(30) Foreign Application Priority Data

Mar. 7, 2018 (KR) ..... 10-2018-0026857

(51) Int. Cl.
*F23R 3/34* (2006.01)
*F23R 3/14* (2006.01)
*F23R 3/28* (2006.01)

(52) U.S. Cl.
CPC ..... *F23R 3/343* (2013.01); *F23R 3/14* (2013.01); *F23R 3/28* (2013.01); *F23R 3/286* (2013.01)

(58) Field of Classification Search
CPC .... F23R 3/14; F23R 3/286; F23R 3/28; F23R 3/343
See application file for complete search history.

(56) References Cited

U.S. PATENT DOCUMENTS 4,653,278 A * 3/1987 Vinson ..... F23C 7/004 60/737
5,199,265 A * 4/1993 Borkowicz ..... F23D 14/00 60/737
5,259,184 A * 11/1993 Borkowicz ..... F23D 14/00 60/39.55
5,685,139 A * 11/1997 Mick ..... F23D 14/02 239/428
6,216,466 B1 * 4/2001 Alkabie ..... F23C 7/004 60/746
6,334,309 B1 * 1/2002 Dean ..... F23D 11/101 60/737

(Continued)

FOREIGN PATENT DOCUMENTS

JP 2007-285572 A 11/2007
JP 2010-223577 A 10/2010

(Continued)

OTHER PUBLICATIONS

A Korean Office Action dated Apr. 30, 2019 in connection with Korean Patent Application No. 10-2018-0026857 which corresponds to the above-referenced U.S. application. No English translation provided.

*Primary Examiner* — William H Rodriguez

(57) ABSTRACT

Disclosed are a pilot fuel injector, and a fuel nozzle and a gas turbine having the same. The pilot fuel injector is mounted on the fuel nozzle to uniformize the flow of the introduced air and to enable uniform mixing with the fuel, so that a fuel mixed air having a high mixing rate is provided to the combustion chamber. The mixing rate of the fuel mixed air directed to the combustion chamber is increased, thereby suppressing the generation of nitrogen oxides and preventing the flame stagnation.

19 Claims, 14 Drawing Sheets

(56) References Cited

U.S. PATENT DOCUMENTS 6,675,581 B1 * 1/2004 Stuttaford ..... F23R 3/286 60/737
7,707,833 B1 * 5/2010 Bland ..... F23D 14/64 60/737
9,964,043 B2 * 5/2018 Myers ..... F23L 7/002
2002/0192615 A1 * 12/2002 Moriya ..... F23R 3/286 431/278
2003/0217556 A1 * 11/2003 Wiebe ..... F23R 3/286 60/796
2004/0006989 A1 * 1/2004 Stuttaford ..... F23R 3/36 60/776
2004/0006990 A1 * 1/2004 Stuttaford ..... F23R 3/286 60/776
2004/0006991 A1 * 1/2004 Stuttaford ..... F23R 3/36 60/776
2004/0006992 A1 * 1/2004 Stuttaford ..... F23R 3/286 60/776
2004/0006993 A1 * 1/2004 Stuttaford ..... F23L 7/002 60/776
2004/0123597 A1 * 7/2004 Kraft ..... F23D 14/64 60/737
2004/0177615 A1 * 9/2004 Martling ..... F23R 3/346 60/740
2004/0229178 A1 * 11/2004 Mandai ..... F23R 3/343 431/195
2005/0223713 A1 * 10/2005 Ziminsky ..... F23D 14/74 60/776
2005/0268614 A1 * 12/2005 Widener ..... F23R 3/286 60/772
2006/0080966 A1 * 4/2006 Widener ..... F02C 3/20 60/775
2007/0089425 A1 * 4/2007 Motter ..... F23R 3/286 60/775
2008/0078179 A1 * 4/2008 Cai ..... F23R 3/286 60/748
2008/0148736 A1 * 6/2008 Ishizaka ..... F23R 3/14 60/737
2009/0165436 A1 * 7/2009 Herbon ..... F23R 3/286 60/39.826
2009/0223225 A1 * 9/2009 Kraemer ..... F23R 3/40 60/723
2009/0320484 A1 * 12/2009 Lacy ..... F23R 3/10 60/748
2010/0011772 A1 * 1/2010 Gashi ..... F23R 3/343 60/748
2010/0077759 A1 * 4/2010 Singh ..... F23R 3/343 60/739
2010/0263381 A1 * 10/2010 Ishizaka ..... F23R 3/14 60/737
2011/0094232 A1 * 4/2011 Stewart ..... F23R 3/14 60/734
2011/0131998 A1 * 6/2011 Nadkarni ..... F23R 3/346 60/737
2011/0162371 A1 * 7/2011 Khan ..... F23R 3/286 60/737
2011/0197587 A1 * 8/2011 Zuo ..... F23R 3/286 60/740
2012/0024985 A1 * 2/2012 Johnson ..... F23R 3/286 239/518
2012/0102957 A1 * 5/2012 Myers ..... F23R 3/36 60/737
2012/0291447 A1 11/2012 Boardman et al.
2013/0067920 A1 * 3/2013 Fox ..... F23R 3/14 60/738
2013/0213051 A1 * 8/2013 Westmoreland, III ..... F23D 14/62 60/775
2016/0169110 A1 * 6/2016 Myers ..... F23R 3/14 60/776
2019/0264921 A1 * 8/2019 Doh ..... F23R 3/286

FOREIGN PATENT DOCUMENTS

JP 2012-032147 A 2/2012
KR 10-0550689 B1 2/2006
KR 10-0542900 B1 3/2006
KR 10-0695269 B1 3/2007
KR 10-2013-0021392 A 3/2013

* cited by examiner

PILOT FUEL INJECTOR, AND FUEL NOZZLE AND GAS TURBINE HAVING SAME

CROSS REFERENCE TO RELATED APPLICATION

The present application claims priority to Korean Patent Application No. 10-2018-0026857, filed on Mar. 7, 2018, the entire contents of which are incorporated herein for all purposes by this reference.

BACKGROUND OF THE DISCLOSURE

1. Field of the Disclosure

The present disclosure relates to a pilot fuel injector, and a fuel nozzle and a gas turbine having the same.

2. Description of the Background Art

Generally, turbines, such as steam turbines, gas turbines, and the like, are machines that obtain rotating force through harnessing impulsive force using a flow of compressed fluid such as gas.

The gas turbine generally includes a compressor, a combustor, and a turbine. The compressor has a compressor casing in which compressor vanes and compressor blades are alternately arranged, along with an air inlet.

The combustor serves to supply fuel to compressed air from the compressor and ignite the air-fuel gas with a burner to produce high temperature and high-pressure combustion gas.

The turbine has a turbine casing in which turbine vanes and turbine blades are alternately arranged. A rotor is centrally disposed through the compressor, the combustor, the turbine, and an exhaust chamber.

The rotor is rotatably supported by bearings at opposite ends thereof. A plurality of disks is fixed to the rotor so that respective blades are attached thereto, and a driving shaft of a driving unit, such as a generator or the like, is coupled to an end side of the rotor on the exhaust chamber side.

Since a gas turbine is devoid of a reciprocating mechanism such as a piston of a 4-stroke engine, there are no friction-causing features such as piston-cylinder contact parts, and thus the turbine has advantages of a significant reduction in lubricant consumption and amplitude of vibration, which is a characteristic of the reciprocating mechanism, whereby high speed movement is enabled.

To briefly explain the operation of the gas turbine, air compressed by the compressor is mixed with fuel and combusted in the combustor to provide hot combustion gas, which is then injected towards the turbine. The injected combustion gas rotates the turbine to create a rotating force.

SUMMARY OF THE DISCLOSURE

Since the combustion gas is obtained by uniformly mixing air and fuel, the combustion gas can be stably combusted. Particularly, when the flow rate of the air is low or the air flow is not uniform, a flame may be generated inside a fuel nozzle, and the parts of the fuel nozzle may be damaged. In addition, nonuniform mixing of air and fuel can increase the combustion temperature or create excessive NOx. Therefore, it may be necessary to keep the flow rate of the air constant and to increase the uniformity of mixing of the air and the fuel.

Accordingly, the present disclosure has been made keeping in mind the above problems occurring in the related art, and an object of the present disclosure is to achieve stable premixing of fuel and air through uniform mixing of the fuel and air.

Another object of the present disclosure is to provide a uniformly mixed air-fuel mixture in a combustion chamber, thereby stably combusting the fuel and reducing nitrogen oxides.

According to an aspect of the present disclosure, there is provided a pilot fuel injector including: a fuel supply pipe through which fuel flows; a perforated plate disposed around the fuel supply pipe while forming a concentric axis with the fuel supply pipe and having a plurality of openings; a fuel peg unit positioned apart from the perforated plate and having a plurality of fuel pegs radially disposed around the fuel supply pipe, each fuel peg having a plurality of fuel injection holes; and a pilot tip having a truncated cone shape, one end of which is connected to a downstream end of the fuel supply pipe, and has a smaller radius toward the other end.

In an embodiment, a cross section of the other end of the pilot tip may have a sectional shape including one of a streamlined curved surface, a flat surface, and a hemispherical surface.

In an embodiment, a groove may be formed in the cross section of the other end of the pilot tip.

In an embodiment, the perforated plate may be provided with a plurality of rectangular openings radially arranged about the center of the perforated plate, wherein the openings have different areas.

In an embodiment, the perforated plate may be provided with a plurality of circular openings arranged in a predetermined pattern, wherein the openings have different areas.

In an embodiment, the openings may be arranged such that as an opening becomes farther away from the center of the perforated plate, an area thereof increases.

In an embodiment, a total area of openings formed in the perforated plate may be 70 to 90% of a total area of the perforated plate including the openings.

In an embodiment, the fuel peg may have a sectional shape including one of streamlined, rectangular, and round shape.

In an embodiment, one or more fuel injection holes may be formed on both sides of the fuel peg.

In an embodiment, the fuel injection holes of the fuel peg may be arranged in a predetermined pattern.

In an embodiment, the fuel injection holes of the fuel peg may be different in size from each other.

In another aspect of the present disclosure, there is provided a fuel nozzle including a center body, a shroud, a rim, and a pilot fuel injector, wherein the pilot fuel injector includes: a fuel supply pipe through which fuel flows; a perforated plate disposed around the fuel supply pipe while forming a concentric axis with the fuel supply pipe and having a plurality of openings; a fuel peg unit positioned apart from the perforated plate and having a plurality of fuel pegs radially disposed around the fuel supply pipe, each fuel peg having a plurality of fuel injection holes; and a pilot tip having a truncated cone shape, one end of which is connected to a downstream end of the fuel supply pipe, and has a smaller radius toward the other end.

In another aspect of the present disclosure, there is provided a gas turbine including a compressor, a combustor, and a turbine, wherein the combustor includes a combustion chamber and at least one fuel nozzle mounted in the combustion chamber, wherein the fuel nozzle includes a center body, a shroud, a rim, and a pilot fuel injector.

As described above, according to embodiments of the present disclosure, the air can be stably introduced to increase the uniformity of an air-fuel mixture, thereby obtaining stable premixing.

According to the present disclosure, the fuel is stably combusted so that nitrogen oxides and combustion vibration can be reduced.

DETAILED DESCRIPTION OF THE DISCLOSURE

Figure 1:
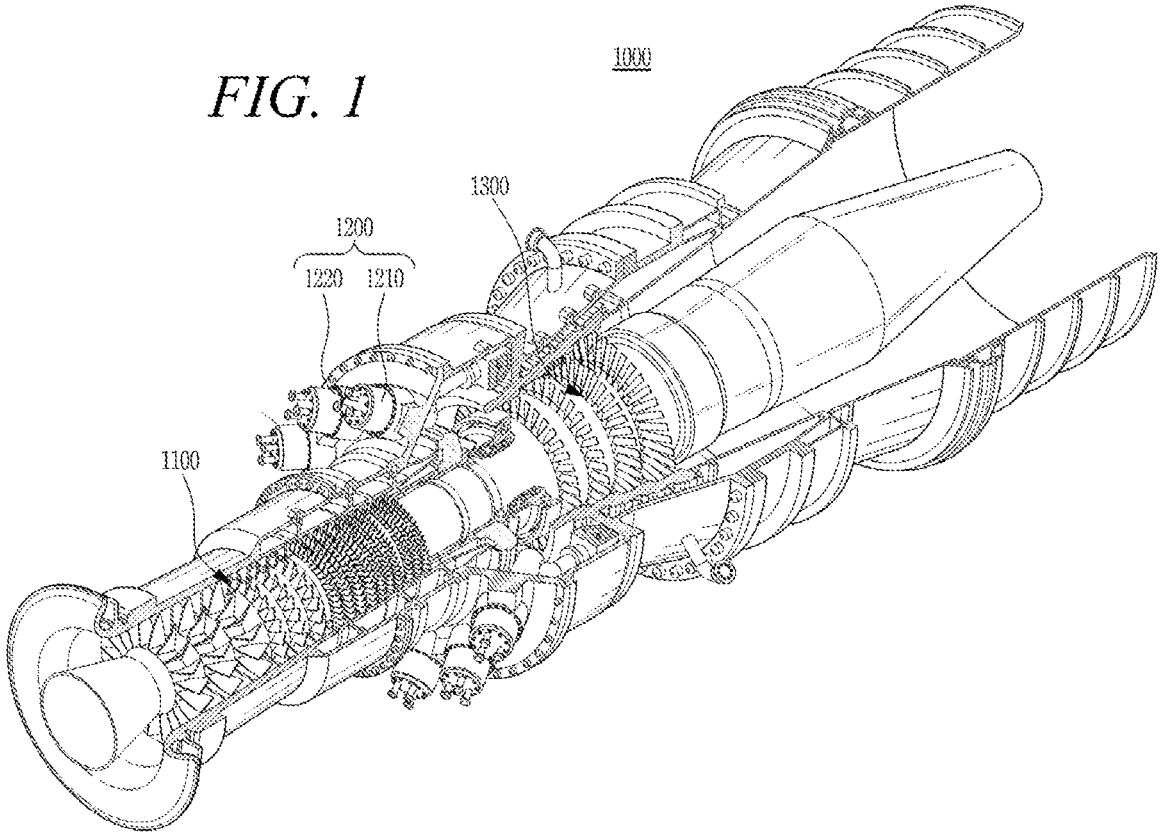
FIG. 1 is a perspective view illustrating a structure of a gas turbine according to the present disclosure.

Example embodiments of the present disclosure will now be described in detail with reference to the accompanying drawings.

In the following description, it is to be noted that, when the functions of conventional elements and the detailed description of elements related with the present disclosure may make the gist of the present disclosure unclear, a detailed description of those elements will be omitted. Wherever possible, the same reference numerals will be used throughout the drawings and the description to refer to the same or like parts. When referring to the drawings, it should be understood that the shape and size of the elements shown in the drawings may be exaggeratedly drawn to provide an easily understood description of the structure of the present disclosure.

It should be understood that, although the terms first and second, A and B, (a) and (b), etc. may be used herein to describe various elements of embodiments of the present disclosure, the terms are only used to distinguish one element from another element, and thus do not limit a feature, order, etc. of the element. In addition, it should be understood that terms concerning attachments, coupling and the like, such as "connected" and "coupled" refer to a relationship wherein structures are secured or attached to one another either directly or indirectly through intervening structures.

An ideal thermodynamic cycle of a gas turbine follows a Brayton cycle. The Brayton cycle consists of four thermodynamic processes: an isentropic compression (adiabatic compression), an isobaric combustion, an isentropic expansion (adiabatic expansion) and isobaric heat ejection. That is, in the Brayton cycle, atmospheric air is sucked and compressed into high pressure air, mixed gas of fuel and the compressed air is combusted at constant pressure to discharge heat energy, the heat energy of the hot expanded combustion gas is converted into kinetic energy, and exhaust gases containing the remaining heat energy are discharged to outside. That is, gases undergo four thermodynamic processes: compression, heating, expansion, and heat ejection. The gas turbine for realizing the Brayton cycle includes a compressor, combustor, and a turbine. FIG. 1 is a schematic view illustrating an entire construction of a gas turbine 1000. Although the present disclosure will be described with reference to FIG. 1, the present disclosure may be widely applied to other similar turbine engines to the gas turbine 1000 shown in FIG. 1.

A compressor 1100 of the gas turbine 1000 is a unit that sucks and compresses air. The compressor 1100 mainly serves both to supply the compressed air for combustion to a combustor 1200 and to supply the compressed air for cooling to a high temperature region of the gas turbine 1000. Since the sucked air undergoes an adiabatic compression process in the compressor 1100, the air passing through the compressor 1100 has increased pressure and temperature.

The compressor 1100 included in the gas turbine 1000 is usually designed as a centrifugal compressor or an axial compressor, wherein the centrifugal compressor is generally applied in a small-scale gas turbine, and a multi-stage axial compressor is generally applied in a large-scale gas turbine which needs to compress a large amount of air.

The compressor 1100 is driven using a portion of the power output from a turbine 1300. To this end, as shown in FIG. 1, a rotary shaft of the compressor 1100 and a rotary shaft of the turbine 1300 are directly connected. In the case of the large-scale gas turbine 1000, approximately half of the output produced by the turbine 1300 is consumed to drive the compressor 1100. Thus, improving the efficiency of the compressor 1100 has a direct and significant effect on improving the overall efficiency of the gas turbine 1000.

The compressor 1100 in a large-scale gas turbine, such as the gas turbine 1000 as shown in FIG. 1, is a multi-stage axial compressor that compresses a great amount of air to a target compression ratio through multiple stages.

Figure 2:
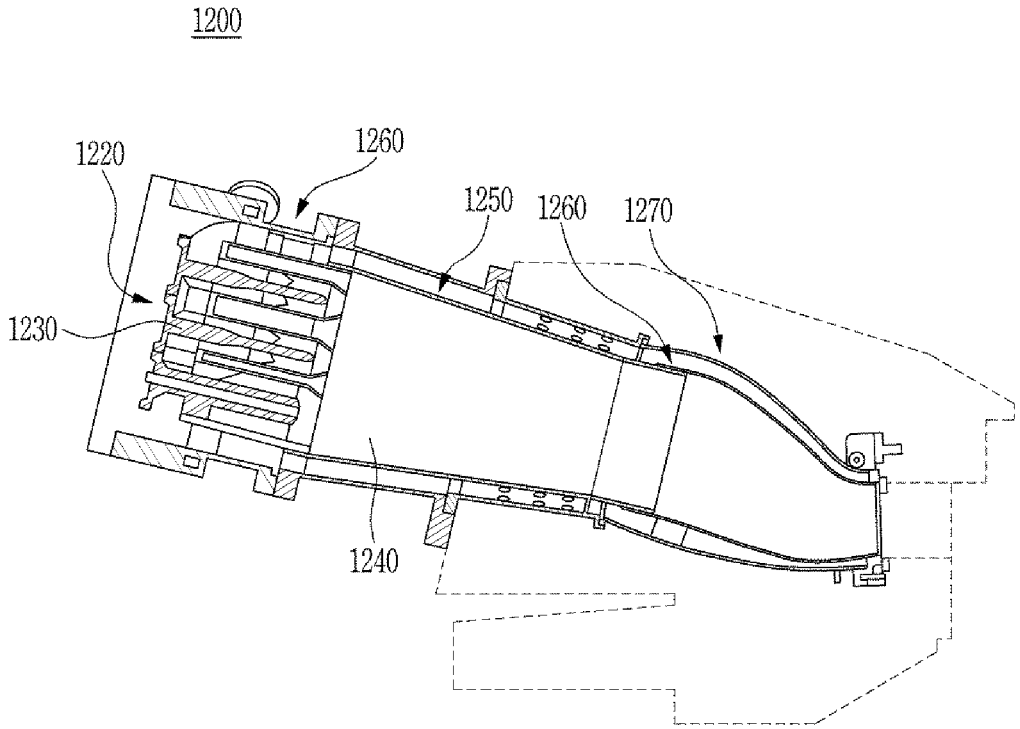
FIG. 2 is a view illustrating a combustor of the gas turbine according to the present disclosure.

The combustor 1200 serves to mix the compressed air supplied from an outlet of the compressor 1100 with fuel and to combust the mixture at constant pressure to produce hot combustion gases. FIG. 2 illustrates an example of the combustor 1200 provided in the gas turbine 1000. The combustor 1200 is disposed downstream of the compressor 1100 such that a plurality of burners 1220 is disposed along an inner circumference of a combustor casing 1210. The burners 1220 each have several combustion nozzles 1230, through which fuel is sprayed into and mixed with air in a proper ratio to form a fuel-air mixture suitable for combustion.

The gas turbine 1000 may use gas fuel, liquid fuel, or a combination thereof. In order to create a combustion environment for reducing emissions such as carbon monoxides, nitrogen oxides, etc. to meet the target of regulation, which may be difficult to achieve for the gas turbine 1000, a gas turbine has a tendency to apply premixed combustion that is advantageous in reducing emissions through lowered combustion temperature and homogeneous combustion. In the premixed combustion, after the compressed air is previously mixed with fuel sprayed from the combustion nozzles 1230, the mixture is supplied to a combustion chamber 1240. When the premixed gas is initially ignited by an ignitor and then the combustion state is stabilized, the combustion state is maintained by supplying fuel and air.

Since the combustor 1200 has a highest temperature environment in the gas turbine 1000, the combustor needs suitable cooling. Referring to FIG. 2, a duct assembly, which includes a liner 1250, a transition piece 1260, and a flow sleeve 1270, is provided to connect a section of the burners 1220 and the turbine 1300 such that the duct assembly heated by hot combustion gas is properly cooled while the hot combustion gas flows towards the combustion nozzles 1230 along an outer surface of the duct assembly.

The duct assembly has a double-wall structure in which the flow sleeve 1270 surrounds the liner 1250 and the transition piece 1260, which are connected by means of an elastic support, wherein compressed air is introduced into an inner annular space of the flow sleeve 1270 to cool the liner 1250 and the transition piece 1260.

Since front and rear ends of the liner 1250 and the transition piece 1260 are fastened to the combustor 1200 and turbine 1300 sides, respectively, the elastic support needs to support the liner 1250 and the transition piece 1260 with a structure capable of accommodating longitudinal and radial extension due to heat expansion.

High temperature, high pressure combustion gas generated by the combustor 1200 is supplied to the turbine 1300 through the duct assembly. In the turbine 1300, the combustion gas undergoes adiabatic expansion and impacts and drives a plurality of blades arranged radially around a rotary shaft so that heat energy of the combustion gas is converted into mechanical energy with which the rotary shaft rotates. A portion of the mechanical energy obtained from the turbine 1300 is supplied as the energy required to compress the air in the compressor, and the rest of the mechanical energy is utilized to drive a generator for producing electric power.

Since the gas turbine 1000 has no major components, such as mutually frictional parts, and thus does not perform a reciprocating motion, the gas turbine has advantages in that its lubricant consumption is very low, the amplitude of its driving motion is reduced, and a high speed motion has become possible.

Since heat efficiency in the Brayton cycle increases as the compression ratio of air increases and turbine inlet temperature (TIT) of the combustion gas introduced during isentropic expansion increases, the gas turbine 1000 is being directed to the increase in the compression ratio and TIT.

Figure 3:
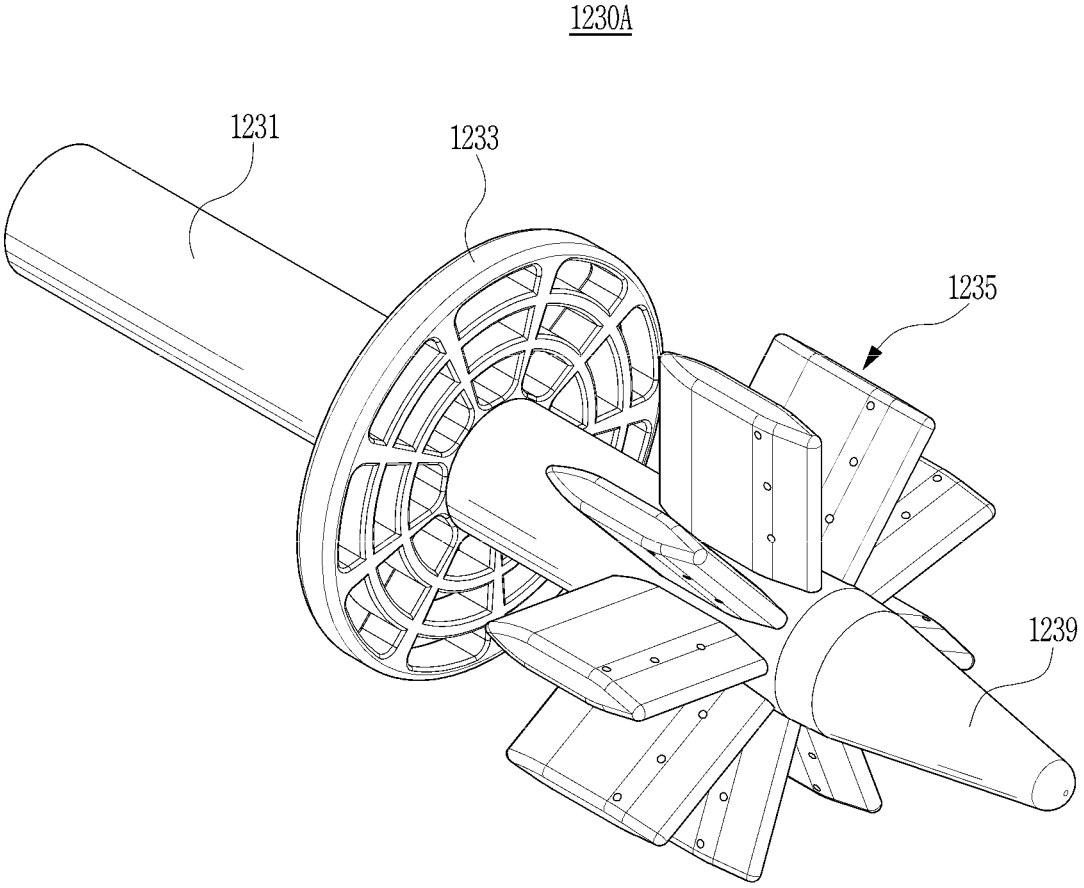
FIG. 3 is a view illustrating a pilot fuel injector according to an embodiment of the present disclosure.
Figure 4:
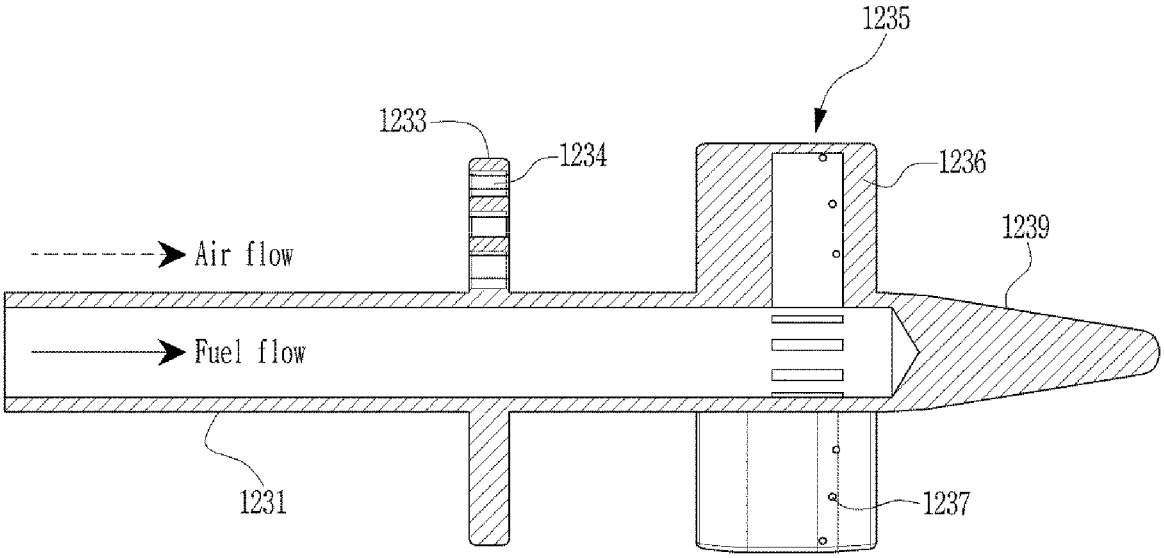
FIG. 4 is a longitudinal sectional view illustrating the pilot fuel injector.

FIG. 3 is a view illustrating a pilot fuel injector according to an embodiment of the present disclosure, and FIG. 4 is a longitudinal sectional view illustrating the pilot fuel injector.

The present disclosure is directed to an apparatus for premixed combustion, (e.g., a pilot fuel injector 1230A) that is able to regulate a flow of air, to increase the uniformity or mixing rate of an air-fuel mixture to reduce emissions of NOx, and to stabilize a combustion flame.

As shown in FIG. 3, the pilot fuel injector 1230A according to the present disclosure includes a fuel supply pipe 1231, a perforated plate 1233, a fuel peg unit 1235, and a pilot tip 1239. The fuel supply pipe 1231 is connected to a fuel tank (not shown) to receive fuel from the fuel tank. The supplied fuel flows into the fuel supply pipe 1231. The perforated plate 1233 is disposed so as to surround a part of the fuel supply pipe 1231. The perforated plate 1233 is formed in a circular disk shape and is concentrically arranged around the fuel supply pipe 1231.

The fuel peg unit 1235 is spaced apart from the perforated plate 1233 around the fuel supply pipe 1231. The fuel peg unit 1235 has a plurality of fuel pegs 1236, which are disposed radially around the fuel feed pipe 1231. Each fuel peg 1236 may be formed in a hexagonal pillar shape having a streamlined side surface. One side of the hexagonal column is fixed to the fuel supply pipe 1231. The fuel peg 1236 is provided with a cavity, into which fuel flowing in the fuel supply pipe 1231 is introduced. On the side face thereof, each fuel peg 1236 is provided with fuel injection holes 1237, through which the fuel introduced into the cavity of the fuel peg 1236 is injected out of the fuel peg 1236.

The pilot tip 1239 is connected to one end of the fuel supply pipe 1231. The pilot tip 1239 is formed in a truncated cone shape having a smaller radius toward a distal end thereof. The pilot tip 1239 allows a fuel mixed air passing through the fuel peg unit 1235 to move toward the center of the inside of the fuel nozzle 1230 so that the uniformity of air-fuel mixture can increase at a radially inner side of the fuel nozzle 1230 as well as a radially outer side of the fuel nozzle 1230.

The pilot fuel injector 1230A is mounted in the fuel nozzle 1230 to regulate the flow of air and increase the uniformity of the air-fuel mixture.

Figure 5:
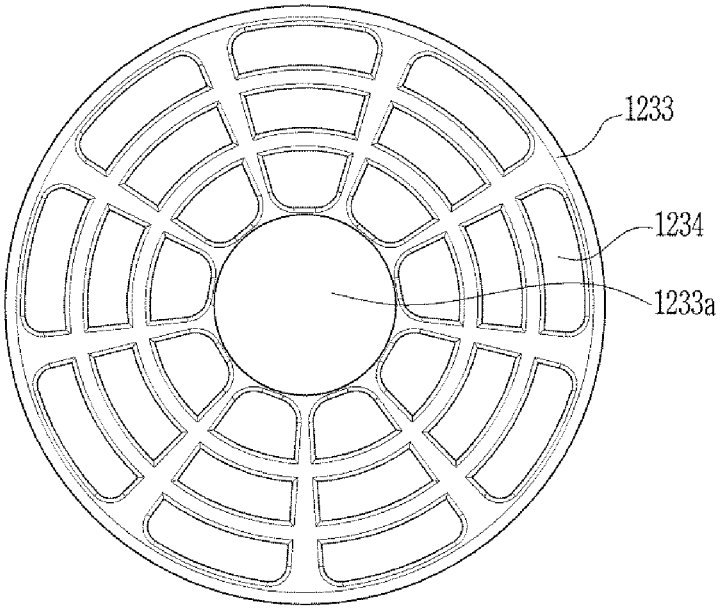
FIG. 5 is a view illustrating a perforated plate in the pilot fuel injector according to an embodiment of the present disclosure.
Figure 6A:
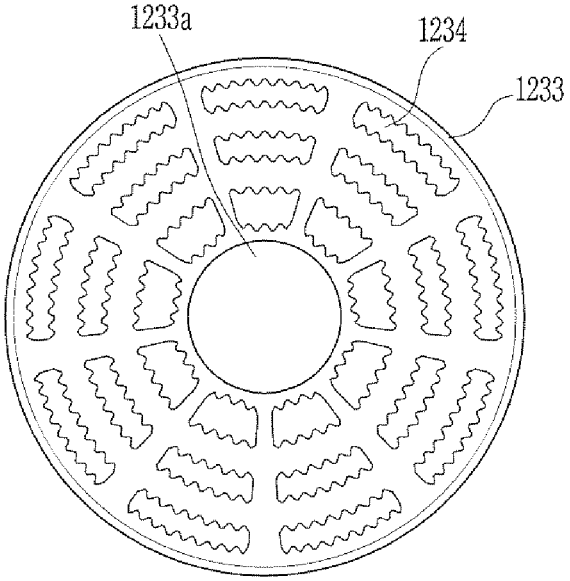
FIGS. 6A and 6B are views illustrating a perforated plate in the pilot fuel injector according to another embodiment of the present disclosure.
Figure 6B:
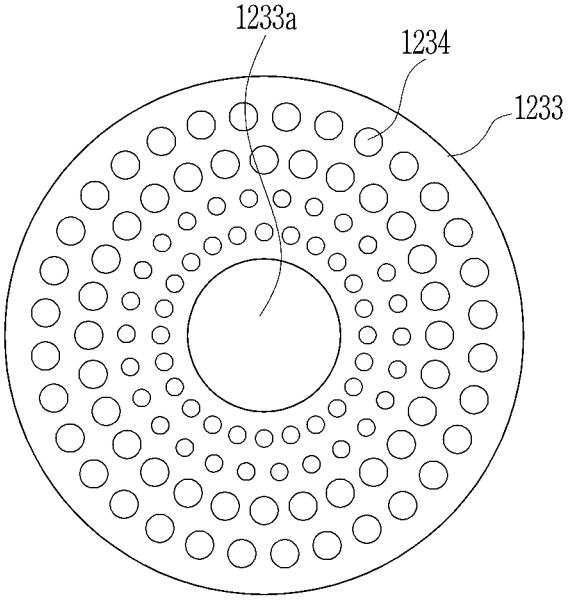

FIG. 5 is a view illustrating a perforated plate in the pilot fuel injector 1230A according to an embodiment of the present disclosure, and FIGS. 6A and 6B are views illustrating a perforated plate in the pilot fuel injector 1230A according to another embodiment of the present disclosure.

The pilot fuel injector 1230A will now be described in more detail.

The perforated plate 1233 is mounted around the fuel supply pipe 1231. As shown in FIG. 5, the perforated plate 1233 is formed in a disk shape. At the center of the perforated plate 1233, a coupling hole 1233*a* is formed for coupling with the fuel supply pipe 1231.

Openings 1234 are formed through the perforated plate 1233 in the thickness direction. The perforated plate 1233 is mounted in the fuel nozzle, and the diameter of the perforated plate 1233 is formed to be equal to or slightly smaller than the diameter of the center body of the fuel nozzle.

The air introduced into the fuel nozzle passes through the openings 1234 of the perforated plate 1233. As the flow of air introduced into the fuel nozzle is decelerated by the perforated plate 1233, the air flow weakens and becomes more uniform. Thus, the flow of introduced air may be regulated by the perforated plate 1233.

On the other hand, the thickness of the perforated plate 1233 may be adjusted according to a desired design. When the thickness of the perforated plate 1233 is increased, the time for air to flow through the openings 1234 of the perforated plate 1233 may take longer and the flow of air may be decelerated.

Air flowing inside the fuel nozzle 1230, that is, outside the fuel supply pipe 1231 flows through the openings 1234 of the perforated plate 1233. The openings 1234 may be arranged in a specified pattern. In one embodiment, the openings 1234 may be radially disposed with respect to the center of the perforated plate 1233. The opening 1234 may have a rectangular shape. In this case, a part of the rectangular opening 1234 may have an arc shape. Each of the openings 1234 may become larger as the distance from the center of the perforated plate increases. The farther the distance from the center of the perforated plate 1233 is, the larger the area of the opening 1234 is so that the flow rate of air flowing through the fuel nozzle 1230 may vary in a radial direction. By making the area of the radially outer openings 1234 larger in the perforated plate 1233, the flow rate of air flowing through the fuel nozzle on the radially outer side may be made relatively fast. The air flow may be controlled by adjusting the shape and area of the openings of the perforated plate 1233.

On the other hand, the opening 1234 of the perforated plate 1233 may have a wavy shape in which grooves are peripherally formed on the surface thereof (see FIG. 6A). In this case, the flow of air has different flow patterns while passing through the wavy surface. That is, the flow of air may be adjusted with the provision of grooves formed in a part of the surface of the opening 1234.

Alternatively, the opening 1234 may have a circular shape. The circular openings 1234 may be arranged in a predetermined pattern on the perforated plate 1233. As shown in FIG. 6B, the openings 1234 may be arranged such that openings having a small diameter are disposed around the center of perforated plate 1233, and openings having a large diameter are disposed on the outer periphery side of the perforated plate 1233. By arranging large-diameter openings on the outer peripheral side from the center, a flow rate of air flowing through the fuel nozzle 1230 may vary in a radial direction. While this embodiment illustrates the large-diameter openings 1234 being disposed on the outer peripheral side of the perforated plate 1233, the present disclosure is not limited thereto. Rather, the arrangement of the openings 1234 may have various sizes and patterns depending on a design of air flow.

The total area of the openings 1234 formed in the perforated plate 1233 may be 70 to 90% of the total area of the perforated plate 1233. The total area of the perforated plate means the sum of the area of the top of the perforated plate 1233 and the area of the openings 1234. If the total area of the openings 1234 is less than 70% of the total area of the perforated plate, the air flow is not easy, and if the total area of the openings 1234 exceeds 90% of the total area of the perforated plate, it is undesirable because the function of adjusting the air flow is weakened. The shape and pattern of the openings 1234 may be adjusted so that the total area falls in the range of 70 to 90% of the total area of the perforated plate 1233.

The perforated plate 1233 may be detachably mounted on the fuel supply pipe 1231 so that the perforated plate 1233 can be replaced according to the design of a combustor.

Figure 7:
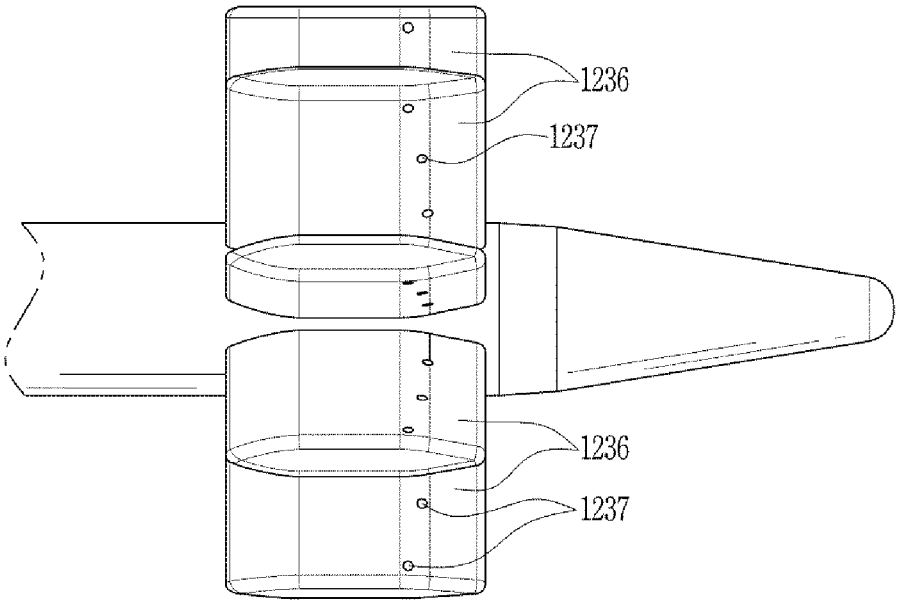
FIG. 7 is a view illustrating a fuel peg unit in the pilot fuel injector according to an embodiment of the present disclosure.
Figure 8:
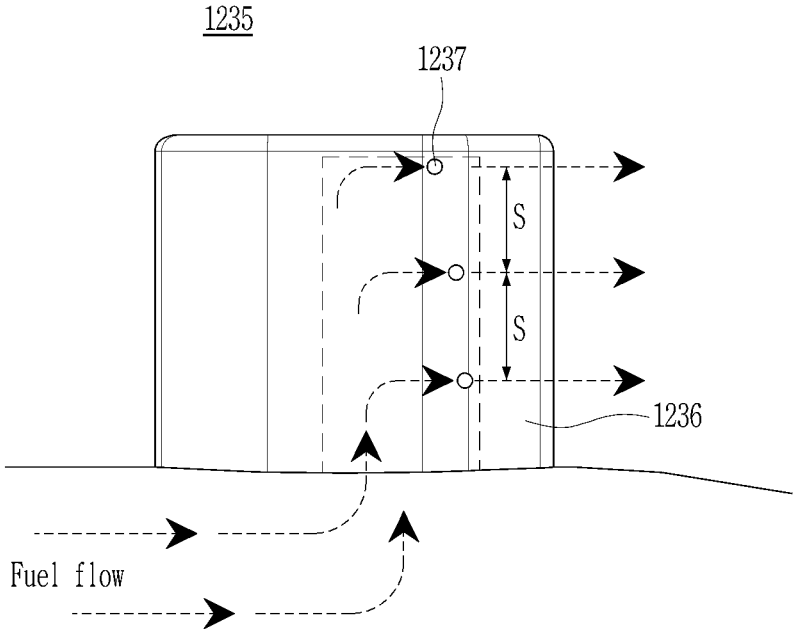
FIG. 8 is a view illustrating that fuel is injected through a fuel peg in the pilot fuel injector according to an embodiment of the present disclosure.
Figure 9:
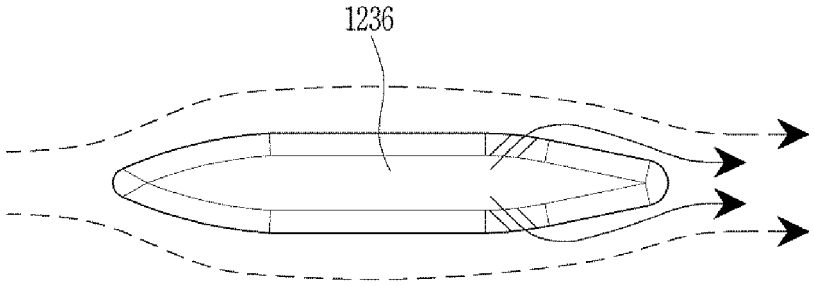
FIG. 9 is a view illustrating a state in which air and fuel injected from the pilot fuel injector flow according to an embodiment of the present disclosure.
Figure 10A:
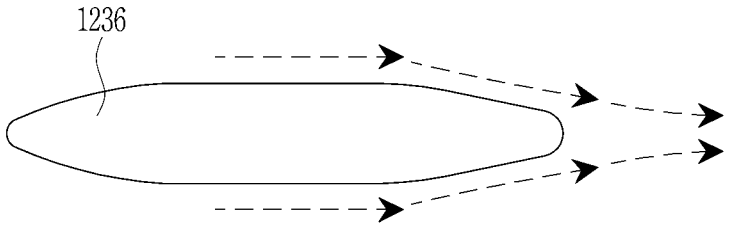
FIGS. 10A, 10B, and 10C are views illustrating a modification of the fuel peg in the pilot fuel injector according to an embodiment of the present disclosure.
Figure 10B:
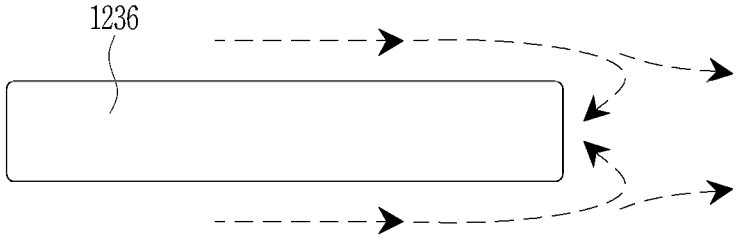
Figure 10C:
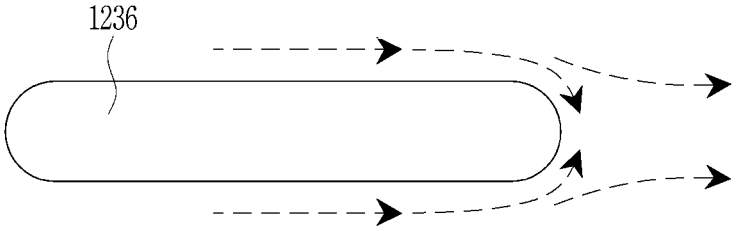

FIG. 7 is a view illustrating the fuel peg unit 1235 in the pilot fuel injector 1230A according to an embodiment of the present disclosure, FIG. 8 is a view illustrating that fuel is injected through a fuel peg in the pilot fuel injector 1230A according to an embodiment of the present disclosure, FIG. 9 is a view illustrating a state in which air and fuel injected from the pilot fuel injector 1230A flow according to an embodiment of the present disclosure, and FIGS. 10A, 10B, and 10C are views illustrating a modification of the fuel peg in the pilot fuel injector 1230A according to an embodiment of the present disclosure.

The fuel peg unit 1235 is spaced apart from the perforated plate 1233 around the fuel supply pipe 1231. As shown in FIG. 7, the fuel peg unit 1235 has the plurality of fuel pegs 1236. The fuel pegs 1236 are each disposed radially around the fuel supply pipe 1231. Each fuel peg 1236 may be formed in a hexagonal pillar shape having a streamlined side surface. The bottom surface of the hexagonal column is fixed to the fuel supply pipe 1231 and the air flowing inside the fuel nozzle moves over the streamlined side of the fuel peg 1236.

Each fuel peg 1236 is provided with a plurality of fuel injection holes 1237, which may be arranged in a predetermined pattern. As shown in FIG. 8, the fuel peg 1236 is provided with a cavity, into which the fuel flowing in the fuel supply pipe 1231 is introduced and sprayed out of the fuel peg through the fuel injection holes 1237.

The fuel injection holes 1237 have different positions on the fuel peg 1236 according to a radial distance from the fuel supply pipe 1231. The fuel injection holes 1237 may be designed such that the fuel injection holes 1237 near the fuel supply pipe 1231 are located in the downstream of a flow direction of air, and the fuel injection holes disposed away from the fuel supply pipe 1231 are located upstream of the flow direction of air.

When the fuel is discharged through the fuel injection holes 1237, the fuel is mixed with the air flowing between the fuel pegs 1236. Here, near the radially inner-side fuel injection holes 1237 which are located downstream of the air flow direction relative to the radially outer-side fuel injection holes 1237, air and fuel are mixed later and the mixing rate is relatively low. However, the fuel and air flowing in proximity to the radially inner-side of the fuel nozzle spread to a wider space while flowing over the pilot tip 1239 so that the fuel and air may have sufficient mixing time and spatial margin. Therefore, even if the fuel mixed air flows through the center of the pilot nozzle 1239 over the pilot nozzle 1239, it may be possible to achieve premix with a high mixing rate as a whole.

The fuel injection holes 1237 are spaced apart at regular intervals in the vertical direction so that the injected fuel can be more evenly mixed with the air flowing through the fuel pegs 1236. While the present embodiment illustrates the spacing S between the fuel injection holes 1237 in the vertical direction being the same, the present disclosure is not limited thereto. The spacing S may be designed to be different if necessary.

On the other hand, the size of the fuel injection hole 1237 may be adjusted as needed. The size of the fuel injection hole 1237 may be designed to be larger or smaller according to the required premixing ratio. The sizes of the plurality of fuel injection holes 1237 need not be the same, and they may be formed differently as needed. For example, the fuel injection holes 1237 may be larger in size as they are disposed radially outwardly on the fuel peg 1236.

FIG. 9 is a view showing the fuel peg 1236 viewed from the side. The inflow air flows over the streamlined side of the fuel peg 1236. The air will flow faster while flowing through the streamlined side of the fuel peg 1236. The fuel injection holes 1237 are formed on the right side of the fuel peg 1236 in the drawing, and the injected fuel is mixed with the air flowing on the side of the fuel peg 1236. The air flowing fast through the side surface of the fuel peg 1236 flows along with the injected fuel, and forms fuel mixed air having a high mixing rate in the fuel nozzle.

While the fuel injection holes 1237 may be formed to be inclined with respect to the thickness direction so that the fuel may be injected in the flow direction of air, the present disclosure is not limited thereto.

In the meantime, the fuel peg 1236 may have various shapes in a cross section. In this embodiment, the cross section of the fuel peg 1236 is a hexagonal shape extending in a flow direction of air. However, the present disclosure is not limited thereto. As shown in FIGS. 10A, 10B, and 10C, the fuel peg 1236 may be formed in a rectangular sectional shape, or a rectangular sectional shape whose both ends are semi-circular. When the fuel peg 1236 has a rectangular sectional shape, the fuel mixed air formed through the fuel peg 1236 strikes the end of the fuel peg 1236, so that the flow rate may be somewhat reduced than when the shape of the fuel peg 1236 is streamlined.

When the shape of the fuel peg 1236 has a rounded shape as shown in FIG. 10C, a flow of the fuel mixed air relatively slows down while passing through the fuel peg 1236, as compared to when the shape of the fuel peg 1236 is streamlined. With the slowdown in the flow of the fuel mixed air, the flow of the fuel mixed air is regulated. According to the present disclosure, the flow and flow rate of the fuel mixed air may be regulated by changing the shape of the fuel peg 1236.

On the other hand, although nine fuel pegs 1236 are disposed in this embodiment, the number of fuel pegs 1236 can be increased or decreased as needed.

Figure 11A:
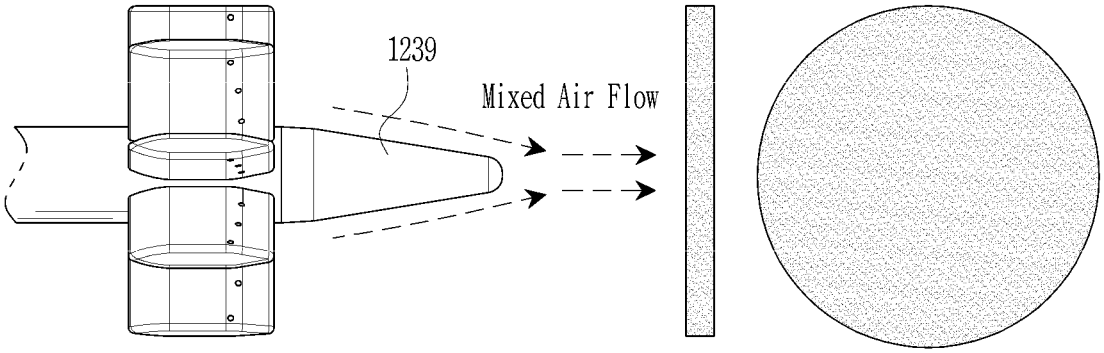
FIGS. 11A and 11B are views illustrating the concentrated distribution of fuel mixed air depending on the presence or absence of a pilot tip in the pilot fuel injector according to an embodiment of the present disclosure.
Figure 11B:
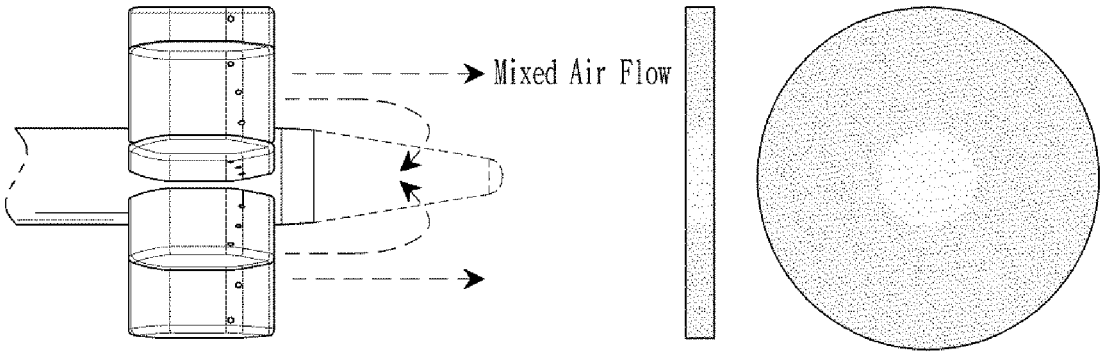
Figure 12A:
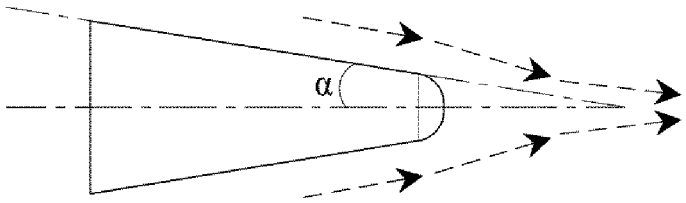
FIGS. 12A, 12B, and 12C are views illustrating a modification of the pilot tip in the pilot fuel injector according to an embodiment of the present disclosure
Figure 12B:
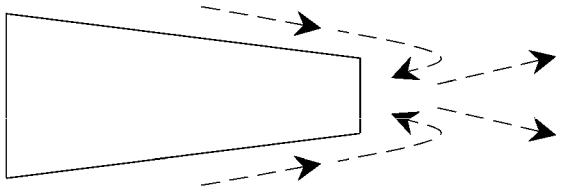
Figure 12C:
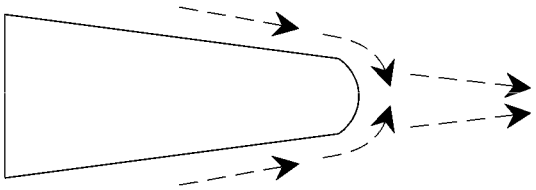
Figure 13:
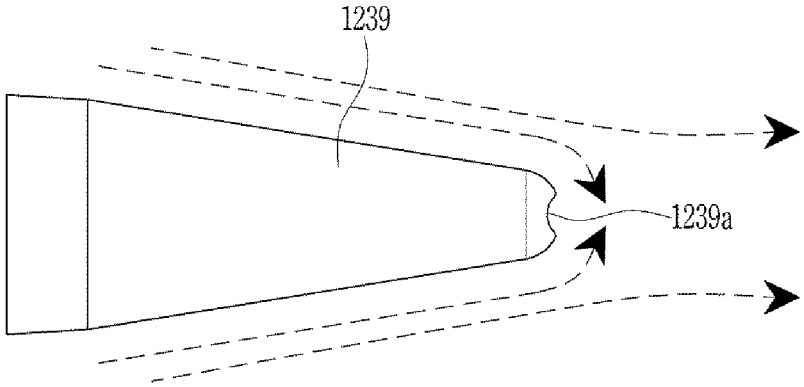
FIG. 13 is a view illustrating a modification of the pilot tip in the pilot fuel injector according to another embodiment of the present disclosure.
Figure 14:
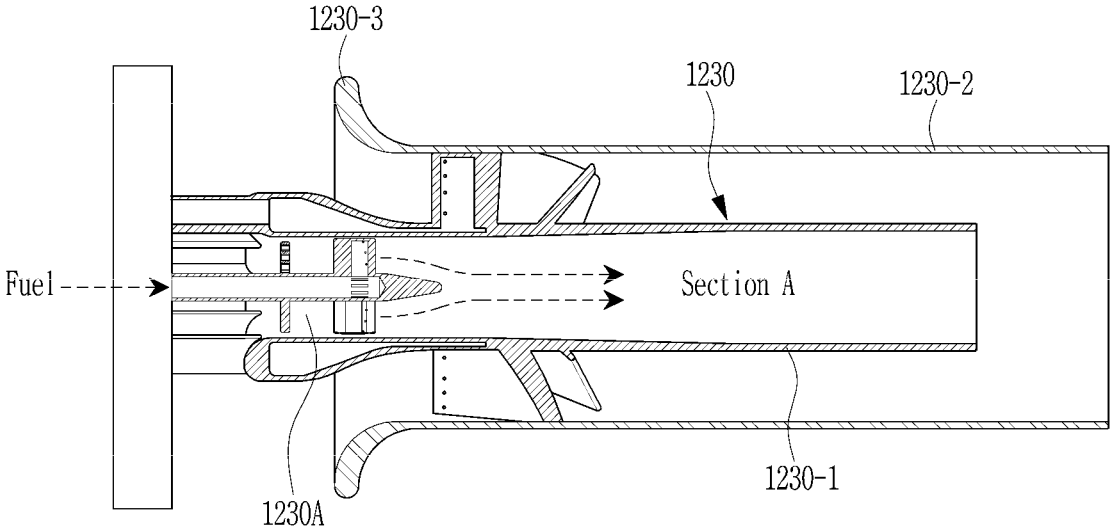
FIG. 14 is a view illustrating a state in which the pilot fuel injector according to the embodiment of the present disclosure is mounted on a fuel nozzle.

FIGS. 11A and 11B are views illustrating the concentration distribution of fuel mixed air depending on the presence or absence of the pilot tip 1239 in the pilot fuel injector 1230A according to an embodiment of the present disclosure, FIGS. 12A, 12B, and 12C are views illustrating a modification of the pilot tip 1239 in the pilot fuel injector 1230A according to an embodiment of the present disclosure, FIG. 13 is a view illustrating a modification of the pilot tip 1239 in the pilot fuel injector 1230A according to another embodiment of the present disclosure, and FIG. 14 is a view illustrating a state in which the pilot fuel injector 1230A according to the embodiment of the present disclosure is mounted on a fuel nozzle. As shown in FIG. 14, a fuel nozzle according to the embodiment of the present disclosure includes a center body 1230-1, a shroud 1230-2, and a rim 1230-3.

As shown in FIG. 11A, the pilot tip 1239 is connected to one end of the fuel supply pipe 1231. The pilot tip 1239 allows the fuel mixed air that has passed through the fuel peg unit 1235 to move toward the radial center of the fuel nozzle so that the radially inner portion as well as radially outer portion of the fuel nozzle can also ensure a sufficient mixing rate.

As shown in FIG. 11B, if there is no pilot tip, the fuel mixed air flowing through the fuel peg unit 1235 is struck against the cross section of the fuel supply pipe 1231. Thus, the radially inner side of the fuel nozzle, being a region where the flow of air is uneven, has a relatively low pressure so that a vortex is generated due to the low pressure. Therefore, the radial inner side of the fuel nozzle may have a low fuel-air mixing rate. As a result, the uniformity of the fuel-air mixture is lowered, leading to incomplete combustion and holding of a flame. The present disclosure can achieve a more uniform premixing due to the pilot tip 1239.

On the other hand, as shown in FIGS. 12A, 12B, and 12C, the pilot tip 1239 is formed in a truncated cone shape having a radius narrowing toward the center axis of the fuel nozzle in the flow direction of the fuel mixed air. The central angle $\alpha$ of the pilot tip 1239 may be adjusted according to the required flow conditions. The central angle $\alpha$ of the pilot tip 1239 is preferably 10 degrees or less. The end of the pilot tip 1239 has a streamlined curved shape allowing the fuel mixed air that has passed through the fuel peg unit 1235 to flow along the pilot tip 1239 to the central portion of the fuel nozzle. As the fuel mixed air flows to the center of the fuel nozzle, the mixing rate of air and fuel in the fuel nozzle may be further increased.

As shown in FIG. 12B, the end of the pilot tip 1239 may be formed in a plane. In this case, the fuel mixed air flowing along the outer surface of the pilot tip 1239 may collide with the end face of the pilot tip 1239, so that the flow rate may be slowed.

As shown in FIG. 12C, the end of the pilot tip 1239 may be formed in a hemispherical shape. In this case, the fuel mixed air flowing along the outer surface of the pilot tip 1239 flows along the section of the pilot tip 1239, and the flow rate of the fuel mixed air may be slowed. The present disclosure may be designed to modify the shape of the cross section of the pilot tip 1239 to regulate the flow of fuel mixed air as needed. In another embodiment, as shown in FIG. 13, a groove 1239*a* may be formed in the end surface of the pilot tip 1239. In this case, the flow of air may be slowed to regulate the entire flow, and the mixing rate of fuel and air in the fuel nozzle can be controlled.

The fuel mixed air is uniformly mixed in the fuel nozzle and then enters the combustion chamber. As shown in FIG. 14, the fuel mixed air flows through the pilot tip 1239 and into a fuel mixing region (Section A). The fuel mixing region (Section A) is a space where the mixing rate of air and fuel is further increased after the fuel injector 1230A. In the present disclosure, the introduced air can be mixed with the fuel while flowing through the perforated plate 1233 and the fuel peg unit 1235, thereby achieving uniform premixing. By increasing the mixing rate of air and fuel, it may be possible to suppress generation of nitrogen oxides to reduce flame backflow and vibration during combustion.

It should be noted that the embodiments disclosed in the specification and drawings are only illustrative of the present disclosure in order to facilitate description and understanding of the present disclosure and are not intended to limit the scope of the present disclosure. It is to be understood by those skilled in the art that other modifications based on the technical scope of the present disclosure are possible in addition to the embodiments disclosed herein.

The invention claimed is:

1. A pilot fuel injector for premixing fuel and air supplied to a fuel nozzle, the pilot fuel injector comprising:

a fuel supply pipe through which the fuel flows;

a perforated plate disposed around the fuel supply pipe to form a concentric axis with the fuel supply pipe and to have a plurality of openings;

a fuel peg unit positioned apart from the perforated plate and including a plurality of fuel pegs radially disposed around the fuel supply pipe, each fuel peg including a plurality of fuel injection holes; and a pilot tip having a truncated cone shape and including a first end connected to a downstream end of the fuel supply pipe, wherein the pilot tip includes a second end opposite to the first end and a center axis passing through the first and second ends, the second end of the pilot tip configured to allow premixed fuel and air having passed through the fuel peg unit to flow along the pilot tip to a central portion of the fuel nozzle, the pilot tip having an outer surface whose cross-section extends linearly between the first and second ends to form a central angle of less than 10° with respect to the center axis, wherein each of the plurality of fuel injection holes of each fuel peg has a different position along a flow direction of air the air according to a radial distance from the fuel supply pipe, the plurality of fuel injection holes including at least one radially inwardly disposed fuel injection hole that is near the fuel supply pipe and is disposed downstream of other fuel injection holes of the plurality of fuel injection holes, and wherein each of the plurality of fuel injection holes of each fuel peg has a different size according to the radial distance from the fuel supply pipe, the at least one radially inwardly disposed fuel injection hole having a smaller size than the other fuel injection holes.

2. The pilot fuel injector of claim 1, wherein the second end of the pilot tip has a cross-sectional shape of a streamlined curved surface, a flat surface, or a hemispherical surface.

3. The pilot fuel injector of claim 1, wherein the second end of the pilot tip has an end face in which a groove is formed to regulate a flow of a mixture of the fuel and the air.

4. The pilot fuel injector of claim 1, wherein the perforated plate is provided with a plurality of rectangular openings radially arranged about a center of the perforated plate.

5. The pilot fuel injector of claim 1, wherein the perforated plate is provided with a plurality of circular openings arranged in a predetermined pattern.

6. The pilot fuel injector of claim 4, wherein the openings are arranged such that as a first opening becomes farther away from the center of the perforated plate than a second opening, an area of the first opening becomes larger than an area of the second opening.

7. The pilot fuel injector of claim 4, wherein a total area of the openings formed in the perforated plate is 70 to 90% of a total area of the perforated plate including the openings.

8. The pilot fuel injector of claim 1, wherein the fuel peg has a sectional shape of streamlined, rectangular, or round shape.

9. The pilot fuel injector of claim 1, wherein the plurality of fuel injection holes of each fuel peg are separated from each other by a constant spacing in a radial direction of the fuel supply pipe.

10. The pilot fuel injector of claim 1, wherein each fuel peg of the plurality of fuel pegs includes a column having a cavity, the column being formed in a hexagonal pillar shape and having one side that is fixed to the fuel supply pipe and is configured to supply the fuel flowing in the fuel supply pipe to the cavity, wherein the hexagonal pillar shape of the each fuel peg of the plurality of fuel pegs includes two side faces that are disposed parallel to the flow direction of the air, two side faces that are disposed to face upstream with respect to the flow direction of the air, and two side faces that are disposed to face downstream with respect to the flow direction of the air, and wherein the plurality of fuel injection holes are formed in one of the two side faces that are disposed to face downstream with respect to the flow direction of the air.

11. A fuel nozzle comprising:

a center body;

a shroud that concentrically surrounds the center body and is spaced apart from the center body;

a rim coupled to an end of the shroud and defining an air inlet; and a pilot fuel injector mounted on an inlet of the center body and configured to premix fuel and air supplied to the fuel nozzle, wherein the pilot fuel injector includes:

a fuel supply pipe through which the fuel flows;

a perforated plate disposed around the fuel supply pipe to form a concentric axis with the fuel supply pipe and to have a plurality of openings;

a fuel peg unit positioned apart from the perforated plate and including a plurality of fuel pegs radially disposed around the fuel supply pipe, each fuel peg including a plurality of fuel injection holes; and a pilot tip having a truncated cone shape and including a first end connected to a downstream end of the fuel supply pipe, wherein the pilot tip includes a second end opposite to the first end and a center axis passing through the first and second ends, the second end of the pilot tip configured to allow premixed fuel and air having passed through the fuel peg unit to flow along the pilot tip to a central portion of the fuel nozzle, the pilot tip having an outer surface whose cross-section extends linearly between the first and second ends to form a central angle of less than 10° with respect to the center axis, wherein each of the plurality of fuel injection holes of each fuel peg has a different position along a flow direction of the air according to a radial distance from the fuel supply pipe, the plurality of fuel injection holes including at least one radially inwardly disposed fuel injection hole that is near the fuel supply pipe and is disposed downstream of other fuel injection holes of the plurality of fuel injection holes, and wherein each of the plurality of fuel injection holes of each fuel peg has a different size according to the radial distance from the fuel supply pipe, the at least one radially inwardly disposed fuel injection hole having a smaller size than the other fuel injection holes.

12. The fuel nozzle of claim 11, wherein the second end of the pilot tip has a cross-sectional shape of a streamlined curved surface, a flat surface, or a hemispherical surface.

13. The fuel nozzle of claim 11, wherein the perforated plate is provided with a plurality of rectangular openings radially arranged about a center of the perforated plate.

14. The fuel nozzle of claim 13, wherein the openings are arranged such that as a first opening becomes farther away from the center of the perforated plate than a second opening, an area of the first opening becomes larger than an area of the second opening.

15. The fuel nozzle of claim 11, wherein the perforated plate is provided with a plurality of circular openings arranged in a predetermined pattern.

16. The fuel nozzle of claim 11, wherein the fuel peg has a sectional shape of streamlined, rectangular, or round shape.

17. The fuel nozzle of claim 11, wherein each fuel peg of the plurality of fuel pegs includes a column having a cavity, the column being formed in a hexagonal pillar shape and having one side that is fixed to the fuel supply pipe and is configured to supply the fuel flowing in the fuel supply pipe to the cavity, wherein the hexagonal pillar shape of the each fuel peg of the plurality of fuel pegs includes two side faces that are disposed parallel to the flow direction of the air, two side faces that are disposed to face upstream with respect to the flow direction of the air, and two side faces that are disposed to face downstream with respect to the flow direction of the air, and wherein the plurality of fuel injection holes are formed in one of the two side faces that are disposed to face downstream with respect to the flow direction of the air.

18. A gas turbine comprising:

a compressor compressing incoming air;

a combustor receiving a compressed air from the compressor, mixing the compressed air with fuel, and combusting an air-fuel mixture; and a turbine rotated by a combustion gas from the combustor to generate power, wherein the combustor includes a combustion chamber and at least one fuel nozzle mounted within the combustion chamber, wherein the fuel nozzle includes:

a center body;

a shroud that concentrically surrounds the center body and is spaced apart from the center body;

a rim coupled to an end of the shroud and defining an air inlet; and a pilot fuel injector mounted on an inlet of the center body and configured to premix fuel and air supplied to the fuel nozzle, wherein the pilot fuel injector includes:

a fuel supply pipe through which the fuel flows;

a perforated plate disposed around the fuel supply pipe to form a concentric axis with the fuel supply pipe and to have a plurality of openings;

a fuel peg unit positioned apart from the perforated plate and including a plurality of fuel pegs radially disposed around the fuel supply pipe, each fuel peg including a plurality of fuel injection holes; and a pilot tip having a truncated cone shape and including a first end connected to a downstream end of the fuel supply pipe, wherein the pilot tip includes a second end opposite to the first end and a center axis passing through the first and second ends, the second end of the pilot tip configured to allow premixed fuel and air having passed through the fuel peg unit to flow along the pilot tip to a central portion of the fuel nozzle, the pilot tip having an outer surface whose cross-section extends linearly between the first and second ends to form a central angle of less than 10° with respect to the center axis, wherein each of the plurality of fuel injection holes of each fuel peg has a different position along a flow direction of the air according to a radial distance from the fuel supply pipe, the plurality of fuel injection holes including at least one radially inwardly disposed fuel injection hole that is near the fuel supply pipe and is disposed downstream of other fuel injection holes of the plurality of fuel injection holes, and wherein each of the plurality of fuel injection holes of each fuel peg has a different size according to the radial distance from the fuel supply pipe, the at least one radially inwardly disposed fuel injection hole having a smaller size than the other fuel injection holes.

19. The gas turbine of claim 18, wherein each fuel peg of the plurality of fuel pegs includes a column having a cavity, the column being formed in a hexagonal pillar shape and having one side that is fixed to the fuel supply pipe and is configured to supply the fuel flowing in the fuel supply pipe to the cavity, wherein the hexagonal pillar shape of the each fuel peg of the plurality of fuel pegs includes two side faces that are disposed parallel to the flow direction of the air, two side faces that are disposed to face upstream with respect to the flow direction of the air, and two side faces that are disposed to face downstream with respect to the flow direction of the air, and wherein the plurality of fuel injection holes are formed in one of the two side faces that are disposed to face downstream with respect to the flow direction of the air.

* * * * *